United States Patent [19]

Harandi et al.

[11] Patent Number: 4,956,509

[45] Date of Patent: Sep. 11, 1990

[54] INTEGRATED PARAFFIN UPGRADING AND CATALYTIC CRACKING PROCESSES

[75] Inventors: Mohsen N. Harandi, Lawrenceville; Hartley Owen, Belle Mead, both of N.J.

[73] Assignee: Mobil Oil Corp., New York, N.Y.

[21] Appl. No.: 422,368

[22] Filed: Oct. 16, 1989

[51] Int. Cl.[5] ..... C10G 35/06

[52] U.S. Cl. ..... 585/300; 585/301; 585/304; 585/910; 208/78

[58] Field of Search ..... 585/910, 300, 301, 304; 208/78

[56] References Cited

U.S. PATENT DOCUMENTS

| | | | |
|---|---|---|---|
| 2,304,183 | 12/1942 | Layng et al. | 585/910 |
| 2,730,556 | 1/1956 | Liedholm | 585/910 |
| 3,714,024 | 1/1973 | Youngblood et al. | 208/78 |
| 3,756,942 | 9/1973 | Cattanach | 208/137 |
| 3,759,821 | 9/1973 | Brennan et al. | 208/93 |
| 3,760,024 | 9/1973 | Cattanach | 260/673 |
| 4,116,814 | 9/1978 | Zahner | 208/78 |
| 4,702,818 | 10/1987 | Oyamoto et al. | 585/910 |
| 4,746,762 | 5/1988 | Avidan et al. | 585/415 |
| 4,840,928 | 6/1984 | Harandi et al. | 208/78 |
| 4,859,308 | 8/1989 | Harandi et al. | 208/78 |

OTHER PUBLICATIONS

"M2-Forming-A Process for Aromatization of Light Hydrocarbons", 24 Ind. Eng. Chem. Process Des. Dev., 151-155 (1986).

*Primary Examiner*—Helane Myers

*Attorney, Agent, or Firm*—Alexander J. McKillop; Charles J. Speciale; Robert B. Furr, Jr.

[57] ABSTRACT

A process is disclosed for decreasing the emission of airborne pollutants from an oil refinery and for upgrading a paraffinic feedstream to olefins and/or aromatics. Flue gas from a fluid catalytic cracking process catalyst regenerator is cooled to supply the endothermic heat of reaction for a paraffin upgrading reaction, eliminating the need for an additional process furnace. The process further decreases airborne pollutant emissions by upgrading paraffinic fractions which would otherwise be burned as fuel.

28 Claims, 2 Drawing Sheets

FCC REACTOR
RISER
STEAM
GAS OIL/RESID
AIR
PC 101
TC 201

INTEGRATED PARAFFIN UPGRADING AND CATALYTIC CRACKING PROCESSES

FIELD OF THE INVENTION

This invention relates to the field of refinery process heat integration. More particularly, the invention relates to a method for integrating fluid bed catalytic cracking and fluid bed catalytic paraffin dehydrogenation and/or aromatization processes. It has been found that the regenerator flue gas cooling and pressure regulation functions essentail to the operation of a fluid catalytic cracking process are advantageously carried out in conjunction with a fluid bed catalytic paraffin dehydrogenation or aromatization process. The invention reduces the total air pollutant effluent from the refinery, thus facilitating compliance with increasingly stringent air quality regulations.

BACKGROUND OF THE INVENTION

Heat integration has become more widely used in the chemical process industries as energy costs have increased. However, until recently, the decision to invest capital in additional heat exchange capacity to save future energy costs remained solely a business and engineering judgement in which the operational constraints and incremental capital costs of heat integration were weighed against projected energy savings.

Designing two or more chemical process units with interdependent heating and cooling necessarily sacrifices some degree of operational flexibility. Thus one engineering objective in designing a heat integration scheme is to achieve the desired energy savings while minimizing the loss of flexibility.

More recently, however, environmental regulations have assumed a position of prominence in refinery design. Modifications to meet water quality standards and solid waste disposal guidelines add capital cost but generally do not require major modifications to existing refinery conversion processes. Improved wastewater treatment facilities and solid waste disposal techniques enable most conventional refineries to meet federal, state and local wastewater and solid waste regulatory standards.

Meeting air quality standards, however, poses a more challenging problem. These regulations limit stack effluent pollutant concentrations as well as pollutant mass flowrates. The more stringent regulations further limit the number of point sources as well as the total pollutant flow from the manufacturing facility. Examples of point sources in an oil refinery include process furnace stacks, steam boiler stacks and catalytic cracking unit regenerator flue gas stacks.

Turning now to refinery economics, the market demand for light $C_4-$ olefins and $C_6+$ aromatics as petrochemical feedstocks continues to grow. Typical oil refineries generate large quantities of paraffinic light gas which is burned as fuel or flared. Converting this light paraffinic gas to useful olefins and aromatics would transform an economic and environmental liability, i.e. excess light paraffinic gas, into saleable products. The resulting olefins are then easily converted to ethers which are useful for increasing gasoline octane. Thus, by upgrading light paraffinic gas to saleable gasoline, the gasoline market demand may be met with a lower rate of crude consumption.

Paraffin dehydrogenation and aromatization are strongly endothermic. Paraffin aromatization is believed to proceed via a two-step process, i.e. cracking or dehydrogenation followed by olefin aromatization. The olefin aromatization step is exothermic and mitigates the dehydrogenation endotherm to some extent; however, for a paraffin-rich feedstream, aromatization remains a net endothermic reaction.

Dehydrogenation of $C_2$–$C_{10}$ paraffins requires a heat input of about 200 to 1200 BTU per pound of feed, more typically 400 to 700 BTU per pound of feed. The reaction temperature in the presence of ZSM-5 catalyst ranges from about 510° C. to 705° C. (950° F. to 1300° F.). Preheating the feed in a fired process furnace may partially crack the feed to form $C_2-$ gas and coke. Paraffin dehydrogenation in a fluidized-bed reaction zone provides the additional option of transferring heat to the reaction zone by preheating the catalyst. Preheating the catalyst separately to around 870° C. (1600° F.) undesirably accelerates catalyst deactivation. The problem of transferring heat to the fluidized-bed process has clearly been an obstacle to its commercial development.

Maintaining and closely controlling relatively small pressure differentials, e.g. less than 5 psi, between the different reaction zones of a fluid catalytic cracking process is essential to its reliable operation. The catalyst regeneration section of a fluid catalytic cracking process operates at pressures up to about 450 kPa (50 psig), and the resulting regenerator flue gas must be depressured before it is exhausted to atmosphere. Orifice chambers typically comprising a plurality of perforate plates traversing a closed longitudinally extensive pressure vessel have gained wide acceptance in industry as a reliable means for depressuring regenerator flue gas and require only minor periodic maintenance to repair damage from catalyst erosion.

Flue gas flows out of the regenerator at temperatures in the range of about 590° to 820° C. (1100° to 1500° F.). In a conventional fluid catalytic cracking unit, this flue gas first flows through an orifice chamber which depressures the flue gas. The depressured flue gas then flows to a heat recovery unit, e.g., a steam generator, where the flue gas temperature falls to around 190° C. (375° F.). From the heat recovery unit, the cooled flue gas flows to a gas purification unit, e.g., an electrostatic precipitator, to remove catalyst fines, and is then exhausted to atmosphere through an elevated stack.

SUMMARY OF THE INVENTION

The present invention enables the refiner to operate a strongly endothermic paraffin upgrading process such as dehydrogenation or aromatization while decreasing overall pollutant emissions to the atmosphere. Flow of light $C_4-$ paraffinic gas to the flare is also decreased as the paraffinic $C_2$–$C_4$ fractions of excess fuel gas which would otherwise be flared are converted to olefinic and aromatic fractions which are marketable both as chemical intermediates as well as end products. Further, the present process enalbles the refiner to add dehydrogenation and aromatization capacity while meeting the applicable air quality standards.

The invention accomplishes these and other objectives by the steps of mixing a hydrocarbon feed with a regenerated cracking catalyst in a fluid bed catalytic cracking reaction zone under cracking conditions sufficient to convert at least a portion of said hydrocarbon feed to product containing gasoline and distillate boiling range hydrocarbons whereby said regenerated cracking catalyst is at least partially coked and deactivated, withdrawing a portion of said at least partially coked and deactivated cracking catalyst from said catalytic cracking reaction zone, contacting said at least partially coked and deactivated cracking catalyst with an oxygen-containing regeneration gas in a fluid bed oxidative regeneration zone maintained at superatmospheric pressure, whereby coke is oxidatively removed from said cracking catalyst and a hot flue gas is generated, contacting a $C_2$–$C_{10}$ paraffinic feedstream with a catalyst in a reaction zone under conversion conditions to produce a reaction zone effluent stream, and maintaining pressure within said fluid bed oxidative regeneration zone by withdrawing hot flue gas from said oxidative regeneration zone and flowing said withdrawn hot flue gas through a heat exchange conduit positioned within said reaction zone to heat said reaction zone and to cool said flue gas.

The invention further comprises a process for decreasing the emission of airborne pollutants from an oil refinery comprising the steps of mixing a hydrocarbon feed with a regenerated cracking catalyst in a fluid bed catalytic cracking reaction zone under cracking conditions sufficient to convert at least a portion of said hydrocarbon feed to product containing gasoline and distillate boiling range hydrocarbons whereby said regenerated cracking catalyst is at least partially coked and deactivated, withdrawing a portion of said at least partially coked and deactivated cracking catalyst from said catalytic cracking reaction zone, contacting said at least partially coked and deactivated cracking catalyst with an oxygen-containing regeneration gas in a fluid bed oxidative regeneration zone maintained at superatmospheric pressure, whereby coke is oxidatively removed from said cracking catalyst and a hot flue gas is generated, contacting a $C_5$— paraffinic feedstream with a catalyst to convert at least a portion of said paraffinic feedstream to a product stream containing olefins and aromatics to decrease the net production of refinery flare gas, maintaining pressure within said fluid bed oxidative regeneration zone by withdrawing hot flue gas from said oxidative regeneration zone and flowing said withdrawn hot flue gas through a heat exchange conduit positioned within said reaction zone to supply at least a portion of the endothermic heat of reaction for the conversion of said paraffinic feedstream while avoiding the incremental increase in airborne pollutant emissions associated with the operation of an additional fired process furnace.

BRIEF DESCRIPTION OF THE DRAWING

FIGS. I and II are simplified schematic diagrams illustrating the major processing steps of two embodiments of the present invention.

DETAILED DESCRIPTION

Feedstocks

Figure 1:
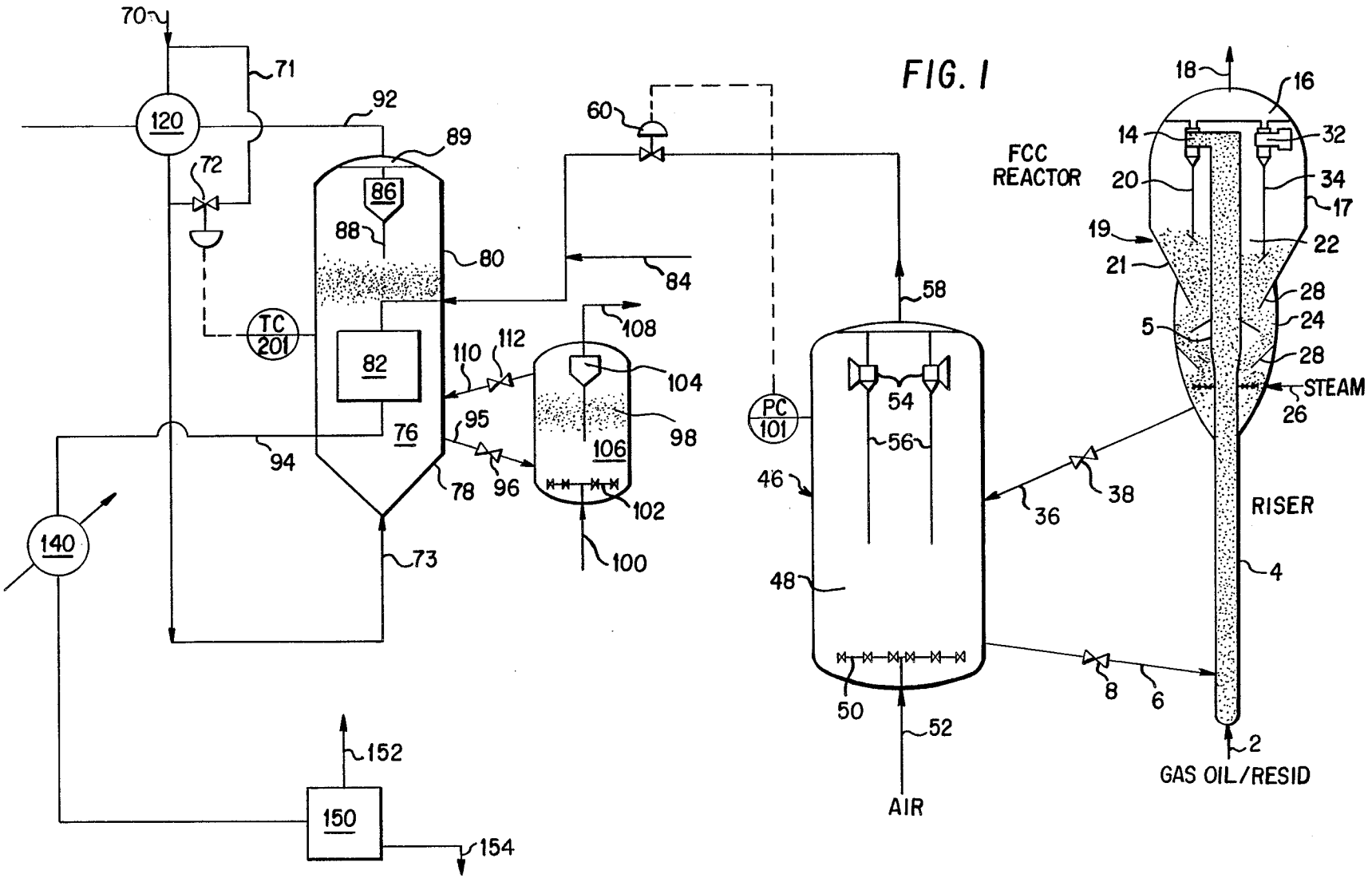

Hydrocarbon feedstocks which can be converted according to the present process include various refinery streams such as $C_2$–$C_4$ paraffinic light gas, coker gasoline, catalytically cracked gasoline, $C_5$ to $C_7$ fractions of straight run naphthas and pyrolysis gasoline. Particularly preferred feedstocks include raffinates from a hydrocarbon mixture from which aromatics have been removed by a solvent extraction treatment. Examples of such solvent extraction treatments are described on pages 706–709 of the *Kirk-Othmer Encyclopedia of Chemical Technology*, Third Edition, Vol. 9, (1980). A particular hydrocarbon feedstock derived from such a solvent extraction treatment is a Udex raffinate.

Reactor Configurations

The present process may be carried out in a tubular, fixed, fluid or moving bed reactor. The reactor must be of sufficient volume to provide sufficient heat exchange area as well as effective space velocities at the available feedstock flowrates. Further, the reactor must provide sufficient flow in contact with the flue gas/reaction zone heat exchange surface to transfer the endothermic heat of reaction from the flue gas stream to the reaction zone. Viewing the reactor and the heat exchange conduit as a shell-and-tube heat exchanger, the flue gas may flow through one of either the shell side or the tube side. The reactor configuration preferably allows for continuous regeneration of coked catalyst as well as continuous or periodic addition of fresh makeup catalyst concurrent with normal process operation. Accordingly, the present process is most preferably carried out in a turbulent fluid bed reactor as described in U.S. Pat. No. 4,746,762 to Avidan et al.

The Preferred Fluid Bed Reactor

Fluidized bed catalysis facilitates control of catalyst activity and coke content, both of which are critical in paraffin upgrading reactions such as aromatization and dehydrogenation. Another important advantage is the close temperature control that is made possible by turbulent regime operation, wherein the uniformity of conversion temperature can be maintained within close tolerances, often less than 15° C. (30° F.). Except for a small zone adjacent the bottom feedstock inlet, the midpoint temperature measurement is representative of the entire bed, due to the thorough mixing achieved.

A convenient measure of turbulent fluidization is the bed density. A typical turbulent bed has an operating density of about 100 to 500 kg/m$^3$, measured at the bottom of the reaction zone, generally becoming less dense toward the top of the reaction zone, due to pressure drop, particle size differentiation and increased molar flowrate. Pressure differential between two vertically spaced points in the reactor column can be measured to obtain the average bed density at such portion of the reaction zone. For instance, in a fluidized bed system employing a composite catalyst comprising ZSM-5, said composite catalyst having an apparent packed density of 750 kg/m$^3$ and real density of 2430 kg/m$^3$, an average fluidized bed density of about 300 to 500 kg/m$^3$ is satisfactory.

As the superficial gas velocity is increased in the dense bed, eventually slugging conditions occur and with a further increase in the superficial gas velocity the slug flow breaks down into a turbulent regime. The transition velocity at which this turbulent regime occurs appears to decrease with particle size. The turbulent regime extends from the transition velocity to the so-called transport velocity, as preferred feedstocks indescribed in U.S. Pat. No. 4,547,616 to Avidan et al, which patent is incorporated by reference herein for details of the turbulent fluidization regime.

Several parameters contribute to maintaining the turbulent catalyst fluidization regime preferred for use with the present paraffin upgrading process. The first is catalyst particle size. Whether a medium-pore zeolite catalyst is used for dehydrogenation and/or aromatization or whether a metal or metal oxide on an inert support is used for paraffin dehydrogenation, the composite catalyst should comprise a fine powder with a solid density in the range from about 0.6 to 2 g/cc, preferably 0.9 to 1.6 g/cc. The catalyst particles can be in a wide range of particle sizes up to about 250 microns, with an average particle size between about 20 and 100 microns. The catalyst particles are preferably in the range of about 10–150 microns with the average particle size between 40 and 80 microns. These particles will generally fluidize in a turbulent regime with a superficial gas velocity in the range of about 0.1–1.5 m/s.

The reactor vessel can assume any technically feasible configuration, but several important criteria should be considered. The bed of catalyst in the reactor can be at least about 3 to 20 meters in height, preferably about 9 meters. Fine particles may be included in the bed, especially due to attrition, and the fines may be entrained in the product gas stream. A typical turbulent bed may have a catalyst carryover rate up to about 1.5 times the reaction zone inventory per hour. If the fraction of fines becomes large, a portion of the carryover can be removed from the system and replaced by larger particles. It is preferable to have a fine particle separator, such as a cyclone and/or a sintered metal filter disposed within or outside the reactor shell to recover catalyst carryover and return this fraction continuously to the bottom of the reaction zone for recirculation at a rate of about one catalyst inventory per hour. Optionally, fine particles carried from the reactor vessel entrained with effluent gas can be recovered by a high operating temperature sintered metal filter.

Dehydrogenation Catalysts

Paraffin dehydrogenation catalysts include oxides and sulfides of the elements of Groups IVA, VA, VIA, VIIA and VIIIA of the Periodic Table and mixtures thereof on an inert support such as alumina or silica-alumina. Thus, dehydrogenation may be promoted by sulfides and oxides of titanium, zirconium, vanadium, niobium, tantalum, chromium, molybdenum, tungsten and mixtures thereof. Oxides of chromium alone or in conjunction with other catalytically active species have been shown to be particularly useful in dehydrogenation. Other catalytically active compounds include sulfides and oxides of maganese, iron, cobalt, rhodium, iridium, nickel, palladium, platinum and mixtures thereof.

The above-listed metals of Groups IVA, VA, VIA, VIIA and VIIIA may also be exchanged onto zeolites to provide a zeolite catalyst having dehydrogenation activity. Platinum has been found to be particularly useful for promoting dehydrogenation over zeolite catalysts. Of the platinum-containing zeolite catalysts, Sn- and In-containing zeolites are particularly preferred. Sn-containing zeolites, specifically ZSM-5, are taught in U.S. patent application Ser. No. 211,198, filed June 24, 1988. In-containing zeolites, specifically In-ZSM-5, are taught in U.S. patent application Ser. No. 138,471, filed Dec. 28, 1987. Both applications are incorporated by reference as if set forth at length herein.

Dehydrogenation Process Conditions

Dehydrogenation process conditions broadly include temperatures of about 480° to 710° C. (900° to 1300° F.), pressure of 100 to 2000 kPa (0 to 275 psig) and WHSV of 0.1 to 20 $hr^{-1}$. The space velocity required to achieve the desired extent of dehydrogenation will depend upon, among other factors, the feed composition.

Aromatization Process

Hydrocarbon upgrading reactions compatible with the process of the present invention include both the conversion of aliphatic hydrocarbons to aromatic hydrocarbons as well as the conversion of paraffinic hydrocarbons to olefinic hydrocarbons. Such conversions are discussed by N. Y. Chen and T. Y. Yan in their article "M2 Foming-A Process for Aromatization of Light Hydrocarbons", 25 IND. ENG. CHEM. PROCESS DES. DEV. 151 (1986), the text of which is incorporated herein by reference. The following representative U.S. patents detail the feed compositions and process conditions for the aromatization and dehydrogenation reactions. Paraffin aromatization process conditions are summarized in Table 1.

TABLE 1

| | | |
|---|---|---|
| WHSV | Broad range: | 0.3–10 $hr^{-1}$ |
| | Preferred range: | 1–5 $hr^{-1}$ |
| OPERATING PRESSURE | Broad: | 170–2170 kPa (10–300 psig) |
| | Preferred: | 310–790 kPa (30–100 psig) |
| OPERATING TEMPERATURE | Broad: | 480–820° C. (900–1500° F.) |
| | Preferred: | 560–620° C. (1050–1150° F.) |

U.S. Pat. No. 3,756,942, incorporated by reference as if set forth at length herein, discloses a process for the preparation of aromatic compounds in high yields which involves contacting a particular feed consisting essentially of mixtures of paraffins and/or olefins, and/or naphthenes with a crystalline aluminosilicate, e.g. ZSM-5, under conditions of temperature and space velocity such that a significant portion of the feed is converted directly into aromatic compounds.

U.S. Pat. No. 3,759,821, incorporated by reference as if set forth at length herein, discloses a process for upgrading catalytically cracked gasoline.

U.S. Pat. No. 3,760,024, incorporated by reference as if set forth at length herein, teaches a process for the preparation of aromatic compounds involving contacting a feed consisting essentially of $C_2$–$C_4$ paraffins and/or olefins with a crystalline aluminosilicate, e.g. ZSM-5.

Medium-Pore Zeolite Catalysts

The members of the class of zeolites useful in the process of the present invention have an effective pore size of generally from about 5 to about 8 Angstroms, such as to freely sorb normal hexane. In addition, the structure must provide constrained access to larger molecules. It is sometimes possible to judge from a known crystal structure whether such constrained access exists. For example, if the only pore windows in a crystal are formed by 8-membered rings of silicon and aluminum atoms, then access by molecules of larger cross section than normal hexane is excluded and the zeolite is not of the desired type. Windows of 10-membered rings are preferred, although, in some instances, excessive puckering of the rings or pore blockage may render these zeolites ineffective.

Although 12-membered rings in theory would not offer sufficient constraint to produce advantageous conversions, it is noted that the puckered 12-ring structure of TMA offretite does show some constrained access. Other 12-ring structures may exist which may be operative for other reasons, and therefore, it is not the present intention to entirely judge the usefulness of the particular zeolite solely from theoretical structural considerations.

A convenient measure of the extent to which a zeolite provides control to molecules of varying sizes to its internal structure is the Constraint Index of the zeolite. The method by which the Constraint Index is determined is described in U.S. Pat. No. 4,016,218, incorporated herein by reference for details of the method. U.S. Pat. No. 4,696,732 discloses Constraint Index values for typical zeolite materials and is incorporated by reference as is set forth at length herein.

In a preferred embodiment, the catalyst is a zeolite having a Constraint Index of between about 1 and about 12. Examples of such zeolite catalysts include ZSM-5, ZSM-11, ZSM-12, ZSM-22, ZSM-23, ZSM-35 and ZSM-48.

Zeolite ZSM-5 and the conventional preparation thereof are described in U.S. Pat. No. 3,702,886, the disclosure of which is incorporated herein by reference. Other preparations for ZSM-5 are described in U.S. Pat. Nos. Re. 29,948 (highly siliceous ZSM-5); 4,100,262 and 4,139,600, the disclosure of these is incorporated herein by reference. Zeolite ZSM-11 and the conventional preparation thereof are described in U.S. Pat. No. 3,709,979, the disclosure of which is incorporated herein by reference. Zeolite ZSM-12 and the conventional preparation thereof are described in U.S. Pat. No. 3,832,449, the disclosure of which is incorporated herein by reference. Zeolite ZSM-23 and the conventional preparation thereof are described in U.S. Pat. No. 4,076,842, the disclosure of which is incorporated herein by reference. Zeolite ZSM-35 and the conventional preparation thereof are described in U.S. Pat. No. 4,016,245, the disclosure of which is incorporated herein by reference. Another preparation of ZSM-35 is described in U.S. Pat. No. 4,107,195, the disclosure of which is incorporated herein by reference. ZSM-48 and the conventional preparation thereof is taught by U.S. Pat. No. 4,375,573, the disclosure of which is incorporated herein by reference.

Gallium-containing zeolite catalysts are particularly preferred for use in the present invention and are disclosed in U.S. Pat. No. 4,350,835 and U.S. Pat. No. 4,686,312, both of which are incorporated by reference as if set forth in length herein.

Zinc-containing zeolite catalysts are also preferred for use in the present invention, for example, U.S. Pat. No. 4,392,989 and U.S. Pat. No. 4,472,535, both of which are incorporated by reference as if set forth at length herein.

Catalysts such as ZSM-5 combined with a Group VIII metal described in U.S. Pat. No. 3,856,872, incorporated by reference as if set forth at length herein, are also useful in the present invention.

DESCRIPTION OF A FIRST EMBODIMENT

In a first embodiment of the present invention, regenerator flue gas from a fluid catalytic cracking process provides thermal energy for the endothermic dehydrogenation of a paraffinic stream.

Referring now to FIG. 1, there is schematically illustrated a flowsheet in which a catalytic cracking charge stock (feed), such as gas oil (boiling range 316°–677° C. (600°–1200° F.)), is introduced via line 2, after it is preheated, into riser 4, near the bottom. Thus the gas oil is mixed with hot regen catalyst, such as zeolite Y, introduced through a valved conduit means such as standpipe 6 provided with a flow control valve 8. Because the temperature of the hot regenerated catalyst is in the range from about 675° to 735° C. (1200° to 1350° F.), a suspension of hydrocarbon vapors is quickly formed, and flows upward through the riser 4.

The riser 4 is flared gently outward into a region 5 through which catalyst and entrained hydrocarbons are flowed, being afforded, in this region 5, the contact time preselected to provide desired cracked products. Catalyst particles and the gasiform products of conversion continue past region 5 and are discharged from the top of the riser into one or more cyclone separators 14 housed in the upper portion 17 of the vessel, indicated generally by reference numeral 19. Riser 4 terminates in a "bird cage" discharge device, or an open end "T" connection may be fastened to the riser discharge which is not typically directly connected to the cyclonic catalyst separation means. The effluent from riser 4 comprises catalyst particles and hydrocarbon vapors which are led into the cyclonic separators 14 which affect separation of catalyst from hydrocarbon vapors.

Hydrocarbon vapors from cyclone 14 are discharged to a plenum chamber 16 from which they flow through conduit 18 for further processing and recovery, typically to a fractionator column where the products of cracking are separated into preselected fractions.

Catalyst separated from the vapors descends through dipleg 20 to a fluid bed 22 of catalyst maintained in the lower portion 21 of the vessel 19. The bed 22 lies above, and in open communication with a stripping zone 24 into which the catalyst progresses, generally downward, and countercurrent to upflowing steam introduced through conduit 26. Baffles 28 are provided in the stripping zone to improve stripping efficiency.

Spent catalyst, separated from the hydrocarbon vapors in the cyclones, is maintained in the stripping zone 24 for a period of time sufficient to effect a higher temperature desorption of feed-deposited compounds which are then carried overhead by the steam. The stripping zone is maintained at a temperature of about 1050° F. or even higher if hot regenerated catalyst is introduced into the stripping zone by means not shown.

Stripped catalyst flows though conduit 36, provided with flow control valve 38, to regenerator 46 containing a dense fluid bed 48 of catalyst into the lower portion of which bed, regeneration gas, typically air, is introduced by distributor 50 supplied by conduit 52. Cyclone separators 54 provided with diplegs 56 separate entrained catalyst particles from flue gas and return the separated catalyst to the fluid bed 48. Flue gases pass from the cyclones into a plenum chamber and are removed therefrom by conduit 58. Pressure controller PC 101 regulates the pressure in regenerator 46 by adjusting control valve 60 which is positioned in line 58. Hot regenerated catalyst is returned to the bottom of riser 4 by conduit 6, which is equipped with control valve 8, to continue the process with another conversion cycle, all of which is conventionally practiced.

A paraffinic feedstock, e.g. a stream containing $C_2$–$C_{10}$ paraffins, flows through line 70 to feed/effluent exchanger 120 where it is heated via indirect heat transfer by dehydrogenation reactor effluent flowing through line 92 to a temperature in the range of about 260° to 540° C. (500° to 1000° F.). A portion of the feedstream may bypass feed/effluent exchanger 120 via line 71 which is equipped with flow control valve 72. The preheated feedstock then flows through line 73 into a fluid bed of dehydrogenation catalyst 76 maintained within a lower section 78 of dehydrogenation reactor 80. The paraffinic feedstock vaporizes as it enters the fluid bed 76, which is maintained at a temperature between about 480° and 710° C. (900° and 1300° F.). TC 201 controls the reaction zone temperature by regulating flow through control valve 72. The feedstock preheat temperature varies to maintain reaction temperature within the broad range disclosed above while attaining the desired conversion. The fluid bed 76 is preferably maintained in a sub-transport turbulent fluidization regime. Pressure within the dehydrogenation reactor is controlled at between about 135 and 790 kPa (5 and 100 psig), preferably between about 170 and 450 kPa (10 and 50 psig).

The reaction conditions are controlled to attain between about 30 and 70 weight percent conversion of paraffins to olefins per pass, preferably about 40 weight percent conversion. Using these feedstock conversion rates as a guide, weight hourly space velocity (WHSV) for a Pt-Sn-ZSM-5 catalyst typically falls within the range of 1 to 10 $hr^{-1}$, preferably from 2 to 5 $hr^{-1}$.

Hot flue gas from regenerator 46 flows through line 58 and enters heat exchanger 82 which is positioned within the fluid bed of dehydrogenation catalyst 76. While heat exchanger 82 is illustrated as being piped in a countercurrent configuration, other configurations including cross-flow, co-current flow and combinations thereof may also be used. Heat exchanger 82 comprises at least one conduit, and preferably comprises a plurality of tubes in paralle. Thus heat exchanger 82 may comprise any configuration which meets the pressure drop and heat transfer requirements described above without disturbing the dehydrogenation catalyst turbulent fluidization regime.

Flue gas enters heat exchanger 82 essentially at the catalytic cracking catalyst regenerator operating temperature of about 675° to 735° C. (1200° to 1350° F.) and is cooled to about 510° to 705° C. (950° to 1300° F.). If the endothermic dehydrogenation heat of reaction exceeds the sensible heat available in the flue gas, cracking catalyst regenerator conditions may be adjusted for incomplete combustion. The resulting carbon monoxide-containing flue gas is then burned within heat exchanger 82 in the presence of oxygen-containing combustion gas added to line 58 upstream of heat exchanger 82 via line 84. A combustion promoter, preferably a platinum-containing combustion promoter, may be added upstream from reactor heat exchanger 82.

Heat transfer may optionally be further improved by selecting less effective cyclone separators 54 for use in regenerator 46. The finely divided cracking catalyst particles will increase the amount of heat flowing from the regenerator and will also increase the heat transfer coefficient between the flue gas and the inner walls of heat exchanger 82. A sintered metal filter or cyclone separator (not shown) may also optionally be located in line 94 downstream of reactor 80 to separate catalyst from the cooled flue gas stream and to recycle the catalyst to regenerator 46.

The dehydrogenation reaction product mixture with entrained catalyst particles flows upward within dehydrogenation reactor 80 to at least one cyclone separator 86. Catalyst particles fall through dipleg 88 and return to fluid bed 76 while the product mixture enters plenum chamber 89 and is withdrawn for further processing via overhead product line 92.

Flue gas effluent from the reactor heat exchanger 82 is withdrawn from the reactor 80 via line 94 and is further cooled in a downstream heat recovery system 140° to about 190° C. (375° F.) before it is exhausted to atmosphere. The heat recovery system preferably includes steam generation. Dehydrogenated product flows through overhead product line 92 to feed/effluent exchanger 120 where it is cooled as it preheats fresh feed from line 70. The effluent from dehydrogenation reactor feed/effluent exchanger 120 is then charged to reactor 80 as described above. The cooled flue gas effluent stream withdrawn from heat recovery system 140 via line 144 then enters a final purification apparatus 150 to remove the remaining entrained cracking catalyst fines. A purified flue gas stream flows overhead through line 152 to an atmospheric stack (not shown). Catalyst fines, withdrawn through line 154, are collected for safe disposal in a storage bin (not shown).

Coke formed during the dehydrogenation reaction accumulates on the dehydrogenation catalyst and reduces its catalytic activity. A portion of the dehydrogenation catalyst is continuously withdrawn from dehydrogenation reactor 80 via line 95 and oxidatively regenerated in dehydrogenation catalyst regenerator 98. Control valve 96 regulates the flow of deactivated catalyst through line 95. An oxygen-containing regeneration gas, e.g., air, enters the bottom of dehydrogenation catalyst regenerator 98 through line 100 and distribution grid 102. Entrained regenerated catalyst is separated from dehydrogenation catalyst regenerator flue gas in cyclone separator 104. The regenerated catalyst returns to a fluid bed of dehydrogenation catalyst 106 while the dehydrogenation catalyst regenerator flue gas is withdrawn via line 108. Regenerated catalyst flows back to dehydrogenation reactor 80 through line 110 which is equipped with control valve 112.

Description of a Second Embodiment

In a second embodiment of the present invention, regenerator flue gas from a fluid catalytic cracking process supplies at least a part of the endothermic heat of reaction for a paraffin aromatization process.

Figure 2:
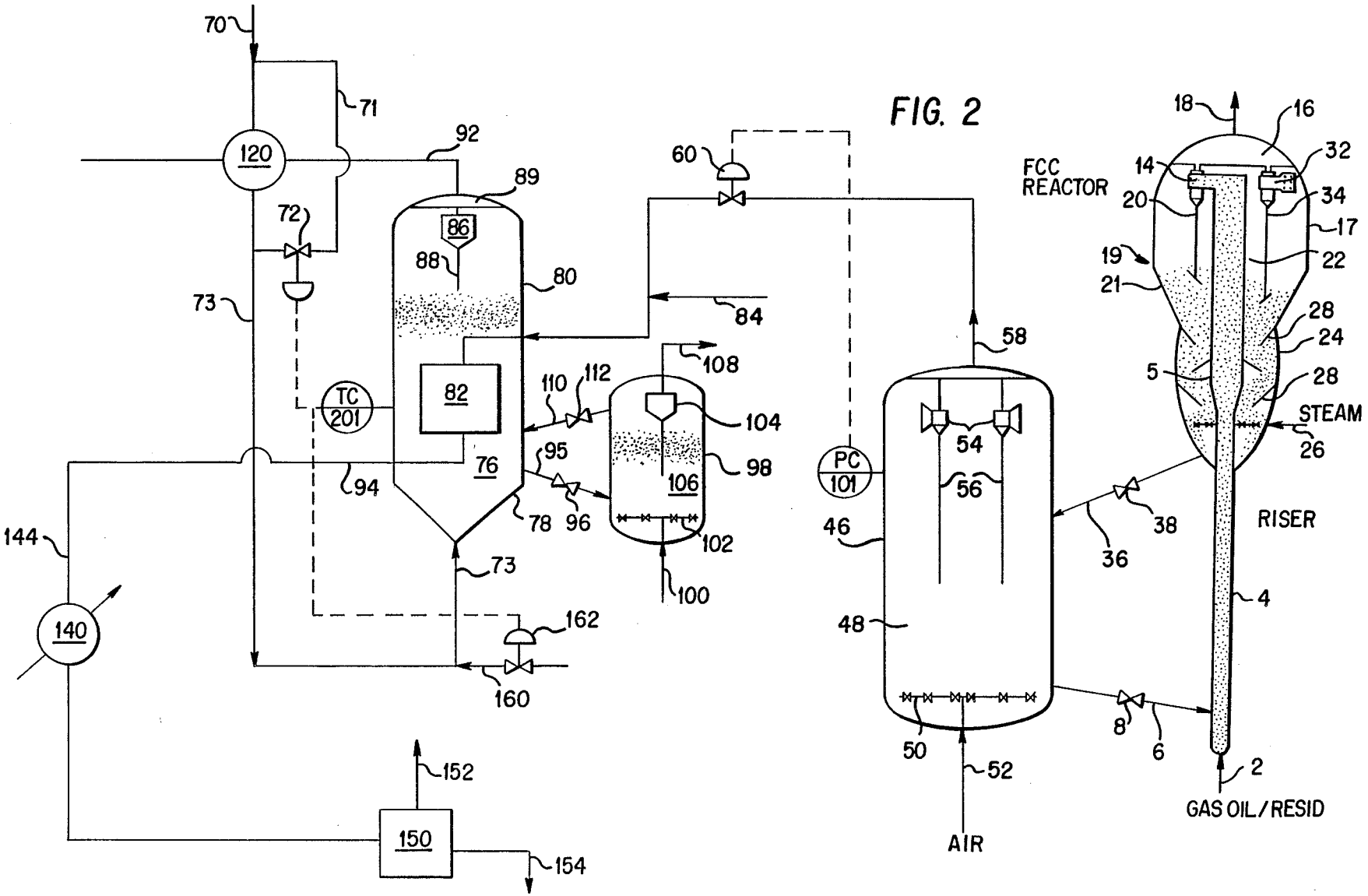

Referring now to FIG. 2, the process configuration for the aromatization embodiment is similar to that of the dehydrogenation embodiment described above.

The fluid bed of catalyst 76 contains an aromatization catalyst, preferably a composite catalyst containing a medium-pore zeolite, examples of which are described above.

Reactor temperature control for the aromatization embodiment also differs from that of the dehydrogenation embodiment. Reactor temperature may be effectively controlled by regulating the feed preheat temperature but is preferably controlled via a two-stage cascaded control scheme. The first stage consists of controlling feed preheat by regulating the flow bypassing exchanger 120.

If control valve 72 is fully closed, providing the maximum feed preheat, and if TC 201 senses a reaction zone temperature below about 480° C. (900° F.), then TC 201 sends the actuator of control valve 162 a proportional signal to open the valve. An olefin-rich stream then flows through line 160 and mixes with the paraffinic feed in line 73. The exothermic olefin aromatization then raises the reaction zone temperature. See, for example, U.S. Pat. No. 3,845,150, incorporated by reference as if set forth at length herein, which teaches the heat-balanced aromatization of a feedstream having a closely controlled composition. Due to the relatively high value of light olefins, it is preferable to minimize the use of the second stage of the cascade temperature control.

Changes and modifications in the specifically described embodiments can be carried out without departing from the scope of the invention which is intended to be limited only by the scope of the appended claims.

What is claimed is:

1. A process for endothermically upgrading a paraffinic feedstream comprising the steps of:

(a) mixing a hydrocarbon feed with a regenerated cracking catalyst in a fluidized bed catalytic cracking reaction zone under cracking conditions sufficient to convert at least a portion of said hydrocarbon feed to product containing gasoline and distillate boiling range hydrocarbons whereby said regenerated cracking catalyst is at least partially coked and deactivated;

(b) withdrawing a portion of said at least partially coked and deactivated cracking catalyst from said catalytic cracking reaction zone;

(c) contacting said at least partially coked and deactivated cracking catalyst with an oxygen-containing regeneration gas in a fluid bed oxidative regeneration zone maintained at superatmospheric pressure, whereby coke is oxidatively removed from said cracking catalyst and a hot flue gas is generated;

(d) contacting a $C_2$–$C_{10}$ paraffinic feedstream with a second catalyst in a catalytic paraffin upgrading reaction zone under conversion conditions to produce a reaction zone effluent stream; and (e) maintaining pressure within said fluid bed oxidative regeneration zone by withdrawing hot flue gas from said oxidative regeneration zone and flowing said withdrawn hot flue gas through a heat exchange conduit positioned within said catalytic paraffin upgrading reaction zone to heat said catalytic paraffin upgrading reaction zone and to cool said flue gas.

2. The process of claim 1 wherein said second catalyst is a dehydrogenation catalyst.

3. The process of claim 2 wherein said second catalyst comprises at least one selected from the group consisting of the elements of Groups IVA, VA, VIA, VIIA, VIIIA and mixtures thereof.

4. The process of claim 2 wherein said second catalyst comprises a zeolite, a dehydrogenation metal, and at least one selected from the group consisting of In and Sn.

5. The process of claim 4 wherein said dehydrogenation metal comprises platinum.

6. The process of claim 4 wherein said zeolite has a Constraint Index of about 1 to 12.

7. The process of claim 4 wherein said zeolite has the structure of ZSM-5.

8. The process of claim 1 wherein said second catalyst is an aromatization catalyst.

9. The process of claim 8 wherein said second catalyst comprises a zeolite.

10. The process of claim 9 wherein said zeolite has a Constraint Index of about 1 to 12.

11. The process of claim 10 wherein said zeolite has the structure of at least one selected from the group consisting of ZSM-5, ZSM-11, ZSM-22, ZSM-23, ZSM-35 and ZSM-48.

12. The process of claim 10 wherein said zeolite contains gallium.

13. The process of claim 2 wherein said conversion conditions comprise temperatures of 480° to 710° C., pressures of 100 to 2000 kPa and WHSV of 1 to 20 $hr^{-1}$.

14. The process of claim 8 wherein said conversion conditions comprise temperatures of about 540° to 820° C., pressures of about 170 to 2170 kPa and WHSV of about 0.3 to 500 $hr^{-1}$.

15. The process of claim 8 wherein said conversion conditions comprise temperatures of about 560° to 620° C., pressures of about 310 to 790 kPa and WHSV of about 1 to 50 $hr^{-1}$.

16. The process of claim 8 further comprising mixing a secondary olefinic stream with said paraffinic feedstream to provide at least a portion of the thermal energy required for the reaction.

17. A process for decreasing the emission of airborne pollutants from an oil refinery comprising the steps of:

(a) mixing a hydrocarbon feed with a regenerated cracking catalyst in a fluid bed catalytic cracking reaction zone under cracking conditions sufficient to convert at least a portion of said hydrocarbon feed to product containing gasoline and distillate boiling range hydrocarbons whereby said regenerated cracking catalyst is at least partially coked and deactivated;

(b) withdrawing a portion of said at least partially coked and deactivated cracking catalyst from said catalytic cracking reaction zone;

(c) contacting said at least partially coked and deactivated cracking catalyst with an oxygen-containing regeneration gas in a fluid bed oxidative regeneration zone maintained at superatmospheric pressure, whereby coke is oxidatively removed from said cracking catalyst and a hot flue gas is generated;

(d) contacting a $C_5$– paraffinic feedstream with a second catalyst in a catalytic paraffin upgrading reaction zone under conversion conditions to convert at least a portion of said paraffinic feedstream to a product stream containing olefins and aromatics to decrease the net production of refinery fuel gas; and (e) maintaining pressure within said fluid bed oxidative regeneration zone by withdrawing hot flue gas from said oxidative regeneration zone and flowing said withdrawn hot flue gas through a heat exchange conduit positioned within said catalytic paraffin upgrading reaction zone to supply at least a portion of the endothermic heat of reaction for the conversion of said paraffinic feedstream while avoiding the incremental increase in airborne pollutant emissions associated with the operation of an additional fired process furnace.

18. The process of claim 17 wherein said second catalyst is a dehydrogenation catalyst.

19. The process of claim 18 wherein said second catalyst comprises at least one selected from the group consisting of the elements of Groups IVA, VA, VIA, VIIA, VIIIA and mixtures thereof.

20. The process of claim 17 wherein said second catalyst is an aromatization catalyst.

21. The process of claim 20 wherein said second catalyst comprises a zeolite.

22. The process of claim 21 wherein said zeolite has a Constraint Index of from about 1 to 12.

23. The process of claim 22 wherein said zeolite has the structure of at least one selected from the group consisting of ZSM-5, ZSM-11, ZSM-22, ZSM-23, ZSM-35 and ZSM-48.

24. The process of claim 22 wherein said zeolite contains gallium.

25. The process of claim 18 wherein said conversion conditions comprise temperatures of 480° to 710° C., pressures of 100 to 2000 kPa and WHSV of 1 to 20 $hr^{-1}$.

26. The process of claim 20 wherein said conversion conditions comprise temperatures of about 540° to 820° C., pressures of about 170 to 2170 kPa and WHSV of about 0.3 to 500 $hr^{-1}$.

27. The process of claim 20 wherein said conversion conditions comprise temperatures of about 560° to 620° C., pressures of about 310 to 790 kPa and WHSV of about 1 to 50 $hr^{-1}$.

28. The process of claim 20 further comprising mixing a secondary olefinic stream with said paraffinic feedstream to provide at least a portion of the thermal energy required for the reaction.

* * * * *